US008316483B2

(12) United States Patent
Thomas et al.

(10) Patent No.: US 8,316,483 B2
(45) Date of Patent: Nov. 27, 2012

(54) FOLDABLE AND PORTABLE PLAYARD ASSEMBLIES WITH A STORAGE COMPARTMENT AND METHODS OF USE THEREOF

(75) Inventors: Wesley H. Thomas, Kenosha, WI (US); Phillip Holsinger, Arbor Vitae, WI (US); Traci J. Barron, St. John, IN (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 13/176,490

(22) Filed: Jul. 5, 2011

(65) Prior Publication Data

US 2011/0266509 A1 Nov. 3, 2011

Related U.S. Application Data

(63) Continuation of application No. 12/070,987, filed on Feb. 22, 2008.

(60) Provisional application No. 60/902,770, filed on Feb. 22, 2007.

(51) Int. Cl.
*A47D 7/00* (2006.01)

(52) U.S. Cl. ..... 5/99.1; 5/98.1; 5/97; 256/25

(58) Field of Classification Search ..... 5/99.1, 5/93.1, 96, 655, 98.1
See application file for complete search history.

(56) References Cited

U.S. PATENT DOCUMENTS 1,451,604 A 4/1923 Wheeler
1,839,580 A 1/1932 Myron
2,059,058 A 10/1936 Swanson
2,133,561 A 10/1938 Thronton-Norris
2,173,639 A 9/1939 Swanson
2,377,024 A 5/1945 Millek
2,486,067 A 10/1949 Schroeder
2,626,407 A 1/1953 Kurry
(Continued)

FOREIGN PATENT DOCUMENTS

CN 1202089 A 12/1998
(Continued)

OTHER PUBLICATIONS

Restriction/Electrion Requirement, issued by the United States Patent and Trademark Office in connection with U.S. Appl. No. 12/070,987, on Jun. 8, 2009, 9 pages.

(Continued)

*Primary Examiner* — Robert G Santos
*Assistant Examiner* — Brittany Wilson
(74) *Attorney, Agent, or Firm* — Hanley, Flight & Zimmerman, LLC

(57) ABSTRACT

Foldable and portable playard assemblies with a storage compartment and methods of use thereof are disclosed. An example playard includes a lower frame having a collapsed position and an erected position, an upper frame having a collapsed position and an erected position and a plurality of corner posts coupling the lower frame and the upper frame. The example playard also includes an upper extension member coupled to and extending from the upper frame and a lower extension member coupled to extending from the lower frame. The upper extension member, the lower extension and two of the plurality of corner posts form a storage compartment frame. In addition, the storage compartment frame remains in an extended position when the lower frame is in the collapsed position and the upper frame is in the collapsed position.

20 Claims, 12 Drawing Sheets

U.S. PATENT DOCUMENTS

| | | | | |
|---|---|---|---|---|
| 2,659,903 | A | | 11/1953 | Hagelfeldt |
| 2,781,526 | A | | 2/1957 | Zimmerman |
| 2,958,084 | A | | 11/1960 | Kenney |
| 3,018,493 | A | | 1/1962 | Wittbrodt |
| 3,064,277 | A | | 11/1962 | Gill |
| 3,158,876 | A | | 12/1964 | Gottlieb |
| 3,654,645 | A | | 4/1972 | Lee |
| 4,811,437 | A | | 3/1989 | Dillner et al. |
| 4,946,180 | A | | 8/1990 | Baer |
| 5,025,517 | A | * | 6/1991 | Johnson ..... 5/99.1 |
| 5,125,674 | A | | 6/1992 | Manuszak |
| 5,170,826 | A | | 12/1992 | Carstensen et al. |
| 5,212,891 | A | | 5/1993 | Schuermann et al. |
| 5,265,894 | A | | 11/1993 | Dunn |
| 5,282,502 | A | | 2/1994 | Ballard |
| 5,430,899 | A | | 7/1995 | Chisholm |
| 5,544,864 | A | | 8/1996 | Gabriel-Lacki et al. |
| 5,586,345 | A | | 12/1996 | Nielsen et al. |
| 5,644,806 | A | | 7/1997 | Mariol et al. |
| D382,718 | S | | 8/1997 | Mariol |
| D393,392 | S | | 4/1998 | Hartenstine |
| 5,754,995 | A | | 5/1998 | Behrendt |
| 5,761,754 | A | | 6/1998 | Cheng |
| 5,813,064 | A | | 9/1998 | Hartenstine |
| 5,862,548 | A | | 1/1999 | Gerhart |
| 5,867,850 | A | | 2/1999 | Mariol |
| 6,067,676 | A | | 5/2000 | Carnahan et al. |
| 6,079,063 | A | | 6/2000 | Cheng |
| D429,929 | S | | 8/2000 | Benson |
| 6,123,091 | A | | 9/2000 | Flynn et al. |
| 6,138,841 | A | | 10/2000 | Klein et al. |
| 6,148,459 | A | | 11/2000 | Verhulst |
| 6,192,535 | B1 | | 2/2001 | Warner, Jr. et al. |
| 6,233,765 | B1 | | 5/2001 | Verhulst |
| 6,263,525 | B1 | | 7/2001 | Liu |
| 6,339,856 | B1 | | 1/2002 | Chen et al. |
| 6,386,379 | B1 | | 5/2002 | Battaglia |
| 6,421,850 | B1 | | 7/2002 | Welsh, Jr. |
| 6,434,768 | B2 | | 8/2002 | Brown et al. |
| 6,438,772 | B1 | | 8/2002 | Brown et al. |
| 6,651,275 | B1 | | 11/2003 | Rummell |
| 6,658,678 | B2 | | 12/2003 | Hotaling et al. |
| 6,675,413 | B2 | | 1/2004 | Hsia |
| 6,687,927 | B1 | | 2/2004 | Tharalson et al. |
| 6,701,547 | B2 | | 3/2004 | Hsia |
| 6,721,970 | B1 | | 4/2004 | Cheng |
| 6,755,435 | B2 | * | 6/2004 | Hsia ..... 5/93.1 |
| 6,848,129 | B1 | | 2/2005 | Amato et al. |
| 6,877,173 | B2 | | 4/2005 | Tharalson et al. |
| 6,895,611 | B2 | | 5/2005 | Tharalson et al. |
| 6,907,627 | B2 | | 6/2005 | Waldman et al. |
| 6,952,849 | B2 | | 10/2005 | Pacella |
| 6,954,949 | B1 | | 10/2005 | Chen |
| 6,959,462 | B2 | | 11/2005 | Chen |
| 7,013,505 | B2 | | 3/2006 | Martin |
| D518,320 | S | | 4/2006 | DeHart et al. |
| D519,763 | S | | 5/2006 | Larger et al. |
| 7,043,778 | B1 | | 5/2006 | Georgitsis et al. |
| D525,062 | S | | 7/2006 | Abdi et al. |
| D526,520 | S | | 8/2006 | Clucas |
| 7,111,339 | B2 | | 9/2006 | Chen |
| 7,228,575 | B2 | | 6/2007 | Chen |
| 7,418,745 | B2 | | 9/2008 | Paesang et al. |
| 7,503,085 | B2 | | 3/2009 | Harrison et al. |
| 7,562,408 | B1 | | 7/2009 | Johnson et al. |
| 2003/0017757 | A1 | | 1/2003 | Murakami et al. |
| 2003/0154547 | A1 | | 8/2003 | Hsia |
| 2004/0064887 | A1 | | 4/2004 | Cheng |
| 2004/0244109 | A1 | | 12/2004 | Koenig et al. |
| 2004/0244110 | A1 | | 12/2004 | Waldman et al. |
| 2005/0268398 | A1 | | 12/2005 | Tharalson et al. |
| 2006/0000018 | A1 | | 1/2006 | Harrison et al. |
| 2006/0000019 | A1 | | 1/2006 | Martin |
| 2006/0026756 | A1 | | 2/2006 | Kavounas |
| 2006/0151560 | A1 | | 7/2006 | Chen |
| 2006/0253978 | A1 | | 11/2006 | Paesang et al. |
| 2006/0253979 | A1 | | 11/2006 | Chen |
| 2008/0000857 | A1 | | 1/2008 | Chen et al. |
| 2008/0189854 | A1 | | 8/2008 | Thorne et al. |
| 2008/0209631 | A1 | | 9/2008 | Thomas et al. |
| 2009/0064409 | A1 | | 3/2009 | Carpenter et al. |

FOREIGN PATENT DOCUMENTS

| | | | |
|---|---|---|---|
| CN | 2403295 | Y | 11/2000 |
| CN | 2440402 | Y | 8/2001 |
| CN | 2492142 | Y | 5/2002 |
| JP | 2006-341658 | | 1/2008 |
| WO | WO94/00034 | | 1/1994 |

OTHER PUBLICATIONS

Non-Final Office Action, issued by the United States Patent and Trademark Office in connection with U.S. Appl. No. 12/070,987, on Aug. 20, 2009, 12 pages.

Final Rejection, issued by the United States Patent and Trademark Office in connection with U.S. Appl. No. 12/070,987, on Mar. 4, 2010, 14 pages.

Advisory Action, issued by the United States Patent and Trademark Office in connection with U.S. Appl. No. 12/070,987, on May 18, 2010, 3 pages.

Non-Final Office Action, issued by the United States Patent and Trademark Office in connection with U.S. Appl. No. 12/070,987, on Jul. 22, 2010, 10 pages.

Notice of Allowance, issued by the United States Patent and Trademark Office in connection with U.S. Appl. No. 12/070,987, on Apr. 4, 2011, 7 pages.

First Notification of Office Action, issued by the State Intellectual Property Office of China in connection with CN Application No. 200810088103.2, on Jul. 24, 2009, 8 pages.

* cited by examiner

FOLDABLE AND PORTABLE PLAYARD ASSEMBLIES WITH A STORAGE COMPARTMENT AND METHODS OF USE THEREOF

RELATED APPLICATION

This patent is a continuation of U.S. patent application Ser. No. 12/070,987, entitled "Foldable and Portable Playard Assemblies with a Storage Compartment and Methods of Use Thereof," filed on Feb. 22, 2008, which claims priority from U.S. Provisional Patent Application Ser. No. 60/902,770, entitled "Foldable and Portable Playard Assemblies with a Storage Compartment and Methods of Use Thereof," filed on Feb. 22, 2007, both of which are hereby incorporated by reference in their entireties.

FIELD OF THE DISCLOSURE

This disclosure relates generally to child care products, and, more particularly, to playard assemblies and methods to use playard assemblies.

BACKGROUND

In recent years, portable playards have become very popular. Portable playards typically include a frame, a flexible enclosure supported by the frame, and a removable floor board or mat. The frame is largely or completely contained within the flexible enclosure so that there are few if any loose parts when the frame is collapsed or when the frame is erected. When collapsed, the portable playard typically has a compact form factor to enable easy transport and storage of the playard. Sometimes, the floorboard is wrapped around the collapsed frame to prevent the frame from inadvertently leaving the collapsed state. One side of the floorboard may include a fabric strap that serves as a handle for carrying the collapsed playard.

DETAILED DESCRIPTION

FIGS. 1-17 provide illustrate example playard assemblies constructed in accordance with the teachings of the invention. Each illustrated example playard assembly is movable between a collapsed position for transportation or storage, and an extended position for use. Each example playard assembly includes a playard portion and a storage compartment. The storage compartment provides additional storage capacity whether the playard assembly is in the collapsed or extended position. To conveniently push or pull the playard assembly when in the collapsed position, each example playard assembly includes an extendable handle and a set of wheels. The playards of these examples are collapsible lengthwise, but not sidewise. When collapsed, the playards have a form factor similar to an upright shopping cart, laundry basket, or piece of luggage such that is can be tilted and rolled on two wheels using the upwardly extending handle in much the way luggage is pulled.

Turning to FIGS. 1-4, a first example playard assembly 100 includes a foldable playard portion 102. A storage compartment 104 is coupled to a front end of the playard portion 102. The storage compartment 104 provides an enclosure or holding area for child care items, such as cleaning products, diapers, clothing, toys, or for other items, as desired. The playard assembly 100 also includes a removable changing table assembly 106 conveniently located above the playard portion 102.

Figure 2:
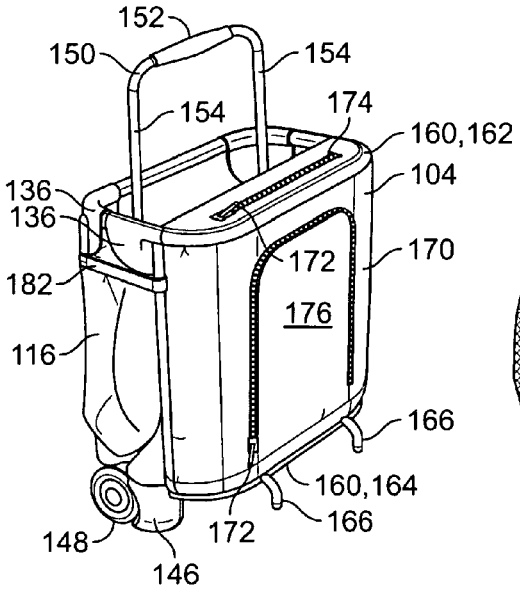
FIG. 2 is a front perspective view of the example playard assembly of FIG. 1 in a collapsed position.
Figure 3:
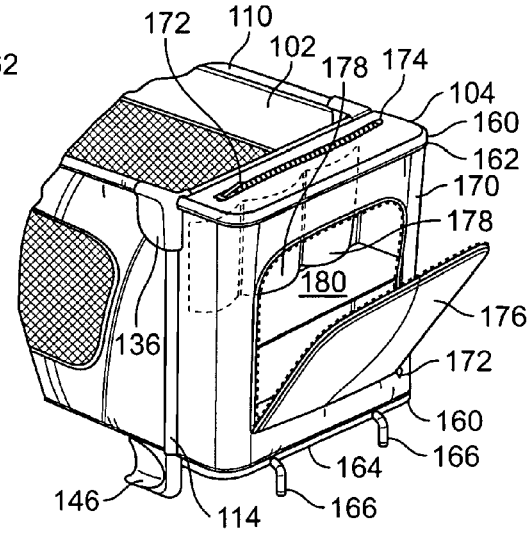
FIG. 3 is a partial front perspective view of the example playard assembly of FIG. 1 in the erected position with the storage compartment door opened.

As shown in FIG. 2, the playard portion 102 of the first illustrated example 100 has a frame 108 including a collapsible upper frame 110, a collapsible lower frame 112, and four upright corner posts 114 that are coupled between the upper frame 110 and the lower frame 112. The changing table 106 is disposed on the upper frame 110 via hooks, clips, straps or any suitable fasteners. In addition, the changing table 106 may be disposed at any desired position along the upper frame 110. The structure of the example changing table 106 and the fasters that couple the changing table 106 to the playard frame 108 may include, for example, any portion of the tables or fasteners described in U.S. patent application Ser. No. 11/101,822 (titled "Clips for Mounting Accessories to Play Yards and Methods of Operating the Same") or U.S. patent application Ser. No. 11/101,821 (tiled "Rockable Sleeping Compartments Attachable to Play Yards and Methods of Operating the Same"), both of which are hereby incorporated herein by reference in their entireties.

Figure 1:
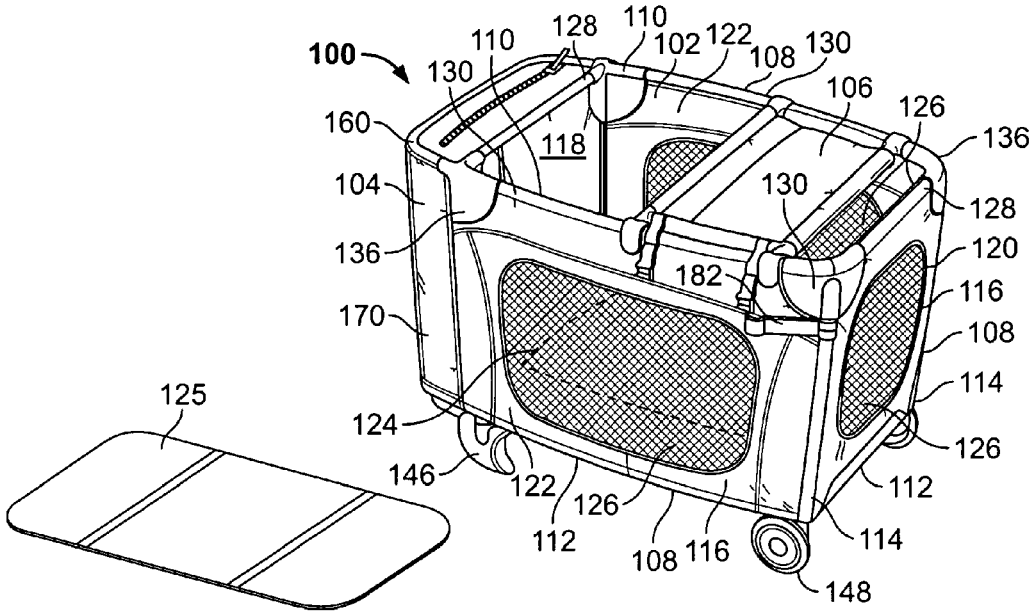
FIG. 1 is a rear perspective view of an example playard assembly constructed in accordance with the teachings of the invention.

FIG. 1 also shows a fabric enclosure 116 secured to the frame 108. The enclosure 116 of the illustrated example includes a front end panel 118, a rear end panel 120, and side panels 122. The enclosure 116 includes a central hole 124 in its bottom. Thus, the enclosure 116 of the illustrated example is annular with at least partially open top and bottom portions. A floor panel 125 is provided to cover the lower frame 112 to provide a support surface when the playard assembly 100 is extended for use in the erected position. The front end panel 118, rear end panel 120 and side panels 122 are secured to the frame 108 and to respective adjacent panels to form the enclosure for an infant or small child when the playard assembly 100 is erected. The removable floor panel 125 provides a padded bottom surface when positioned within the enclosure.

The front end panel 118, rear end panel 120 and side panels 122 may be constructed of any suitable pliable material. In the illustrated example, the rear end panel 120 and side panels 122 have mesh portions 126 for improved visual access and ventilation of the enclosure 116. The front end panel 118, which also serves as a rear panel for the adjacent storage compartment 104, is shown without a mesh portion (i.e., as a solid fabric panel) so as to better conceal and contain the contents of the storage compartment 104. This also reduces the likelihood of a child in the enclosure attempting to access the compartment 104 and/or its contents.

The floor panel 125 may be constructed of any suitable materials. In the illustrated example, the floor board 125 includes one or more fairly rigid sections (e.g., cardboard and/or pressed wood panels with foam or other padding) enclosed by a pliable fabric covering.

Figure 4:
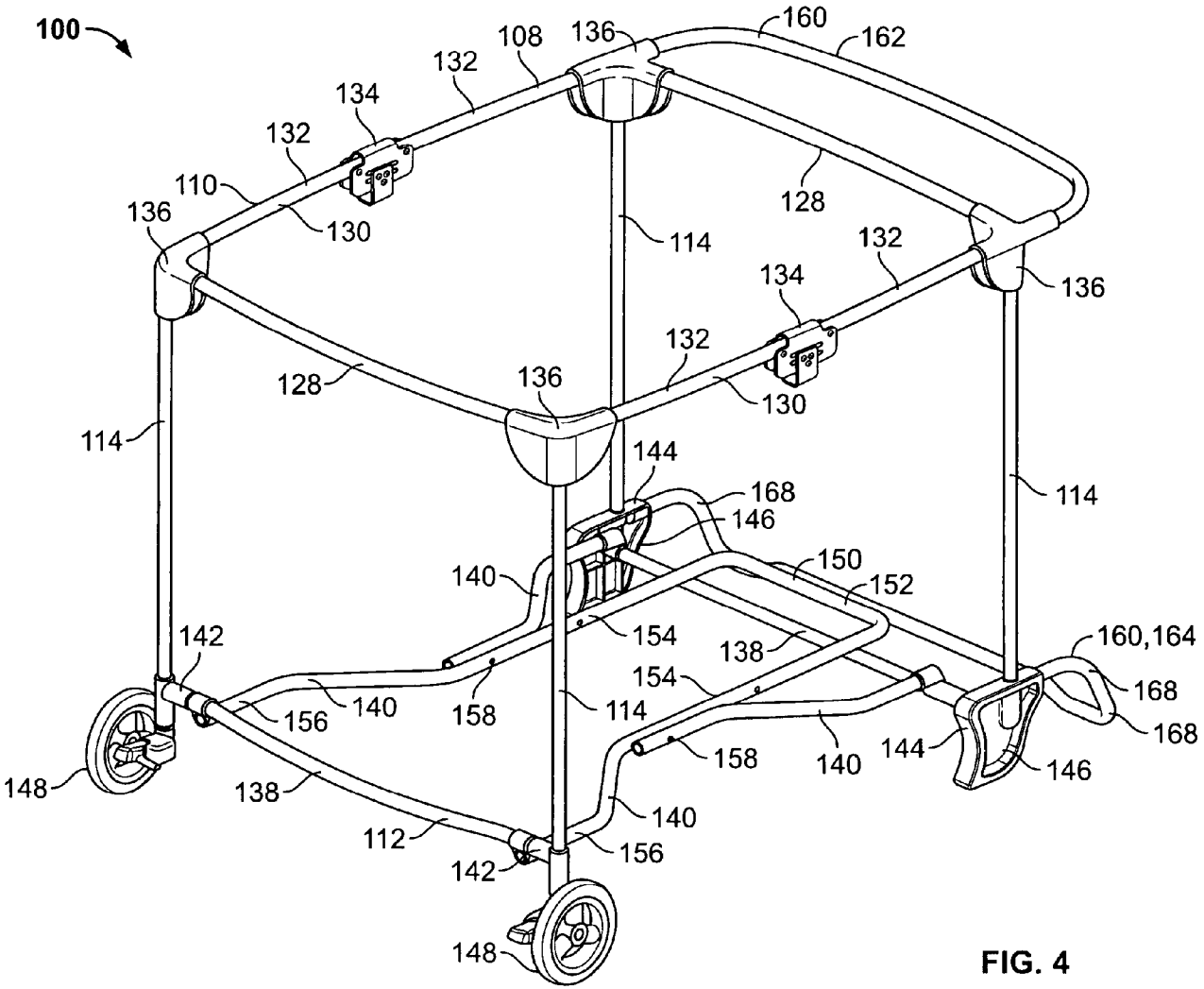
FIG. 4 is a rear perspective view of an example frame for the playard assembly of FIG. 1 with each wheel assembly having a single wheel.

As shown in FIG. 4, the upper frame 110 of the first example playard assembly 100 includes a pair of upper end members 128, and a pair of collapsible side members 130. Each upper collapsible side member 130 includes a pair of rails 132 that are pivotably coupled by a rail joint 134. The rail joint 134 can be constructed in any desired manner to provide a locking mechanism to selectively form a relatively rigid upper side member 130 when the playard assembly 100 is erected for use while also permitting the side member 130 to be collapsed, to move the playard 100 into the collapsed state. In the illustrated example, the upper end members 128 do not collapse. The upper end members 128 and side rails 132 of the upper frame 110 may be constructed of any suitable material such as with relatively rigid (metal or plastic) tubing, or the like.

The upper frame 110 also includes upper corner housings or end caps 136 that may be formed, for example, by molded plastic, formed metal, or the like. In the illustrated example, each upper corner housing 136 couples an end of an upper end member 128 to an end of a side member 130, and to an upper end of an upright corner post 114. In this example, the upper end members 128 and upright corner posts 114 are fixedly coupled to the upper corner housings 136, while the ends of the side members 130 are pivotably coupled to the upper corner housings 136 to facilitate folding of the same.

The lower frame 112 of the playard assembly 100 of the first illustrated example includes a pair of lower end members 138 and a pair of lower rails 140. The lower end members 138 and the lower rails 140 of the lower frame 112 may be constructed in a similar manner to the components of the upper frame 110 (i.e., as metal or plastic tubes). The lower frame 112 also includes rear lower corner housings 142 and front lower corner housings 144 to join the lower end members 138, the lower rails 140 and the lower ends of the corner posts 114.

In the illustrated example of FIG. 4, each rear lower corner housing 142 and front lower corner housing 144 couples an end of a lower end member 138 to a lower end of an upright corner post 114. Within the lower frame 112, each front lower corner housing 142 is pivotally coupled to a first end of a lower rail 140. Each front lower corner housing 144 is also provided with a downward extending leg portion 146, which may be made of metal, plastic, and/or any other suitable material. Each rear lower corner housing 142 is provided with a ground engaging wheel assembly 148. Each wheel assembly 148 may be provided with a caster mechanism or may have a fixed axis of rotation. In the illustrated example, each wheel assembly 148 includes a brake mechanism and a single wheel with a fixed axis of rotation, as shown in FIGS. 4 and 6-10. In an alternative example shown in FIG. 5, each wheel assembly 149 includes a pair of wheels. Any other desired rotatable element may alternatively be used to produce movement over a ground surface.

In the illustrated example, a portion of the lower frame 112 functions as a handle 150. The handle 150 of the illustrated example is a generally U-shaped member having a grasping portion 152 and two sides 154 that terminate in ends 156. In the illustrated example, each of the ends 156 forms a portion of a respective one of the lower rails 140 as shown in FIG. 4. The ends 156 are pivotally coupled to respective ones of the rear lower corner housings 142, but may alternatively or additionally be pivotally coupled to the lower end member 138. The front end and rear end of the lower frame 112 are coupled together via a pivotal coupling 158 joining the lower rails 140. In the illustrated example, the pivotal coupling 158 is at a point along a side of the handle member 150.

In the example of FIGS. 1-4, a frame 160 for the storage compartment is provided at an end of the playard portion 102. To this end, a U-shaped upper extension member 162 is coupled to and extends forward from the front upper corner housings 136. Similarly, coupled to and extending forward from the front lower corner housings 144 is a U-shaped lower extension member 164. The example lower extension member 164 shown in FIGS. 2 and 3 includes a pair of downward projecting legs 166 that contact a ground surface. An alternative lower extension member 164 shown in FIG. 4 includes integral contoured bends 168 that contact a ground surface.

The storage compartment 104 of the example shown in FIGS. 1-4 is enclosed by fabric panels 170 that are secured to the upper and lower extension members 162, 164 and are joined to respective sides of the fabric panel at the front end of the playard portion 102. The fabric panels 170 that form the top, bottom and outer walls of the storage compartment 104 include fasteners 172 to selectively open or close various pockets 174 or doors 176 that are be provided for convenient access to areas within the storage compartment 104. In the example shown in FIGS. 2 and 3, the top and front panels have zippered openings to access interior areas of the relatively large storage compartment 104 and, thus, the fasteners 172 are formed by zippers. The fasteners 172 conceal, seal and/or otherwise contain the contents of the storage compartment. This concealed approach provides from protection against weather elements when moving the playard 100 and reduces the likelihood of a child attempting to access the compartment 104 and/or its contents. In the example shown in FIG. 3, the storage compartment 104 is configured to include internal pockets 178 and/or shelves 180 to receive items that may be stowed in the compartment 104. Locating the storage compartment 104 on an end of the playard assembly 100 permits it to be accessed whether the playard portion 102 is in the extended/erected position for use (e.g., the position of FIG. 1), or is in a collapsed position (e.g., the position shown in FIG. 2) for transportation or storage of the playard assembly 100.

As shown in FIGS. 4-10, the connection of the front and rear ends of the playard portion 102 via the pivotal coupling 158 of the lower rails 140 and the handle member 150 results in a frame assembly having a structure whereby when the playard assembly 100 is erected for use, the rigid handle 150 is pivoted toward the ground surface until a portion of the handle member 150 comes to rest on top of the lower rigid front end member 138. In this position (see FIG. 4), the handle is disposed in a substantially horizontal plane substantially parallel to the ground surface beneath the playard 100. The downward movement of the handle member 150 and its pivotal coupling 158 to the lower rails 140 causes the ends 128, 138 of the playard portion 102 to be driven away from each other until the handle member 150 engages the lower rigid front end member 138. As a result, the pair of upper collapsible side members 130 are extended sufficiently to engage the releasable self-locking mechanisms 134 to lock the pairs of side rails 130 in their extended positions (see FIG. 4). With the frame 108 fully extended, the handle member 150 and the lower rails 140 form a base to support the floor panel 124.

As described above, the fabric enclosure 116 includes a central opening in its bottom panel and/or does not include a floor. The open bottom area permits the pivoting movement of the handle 150 from a substantially vertical handle position (FIG. 2) to a substantially horizontal floor support position (FIG. 4). Although the example of FIG. 1 employs a floor panel with the opening 124 dimensioned to permit movement of the handle 150 between the handle position and the floor support position, other implementations eliminate the floor panel altogether.

Figure 5:
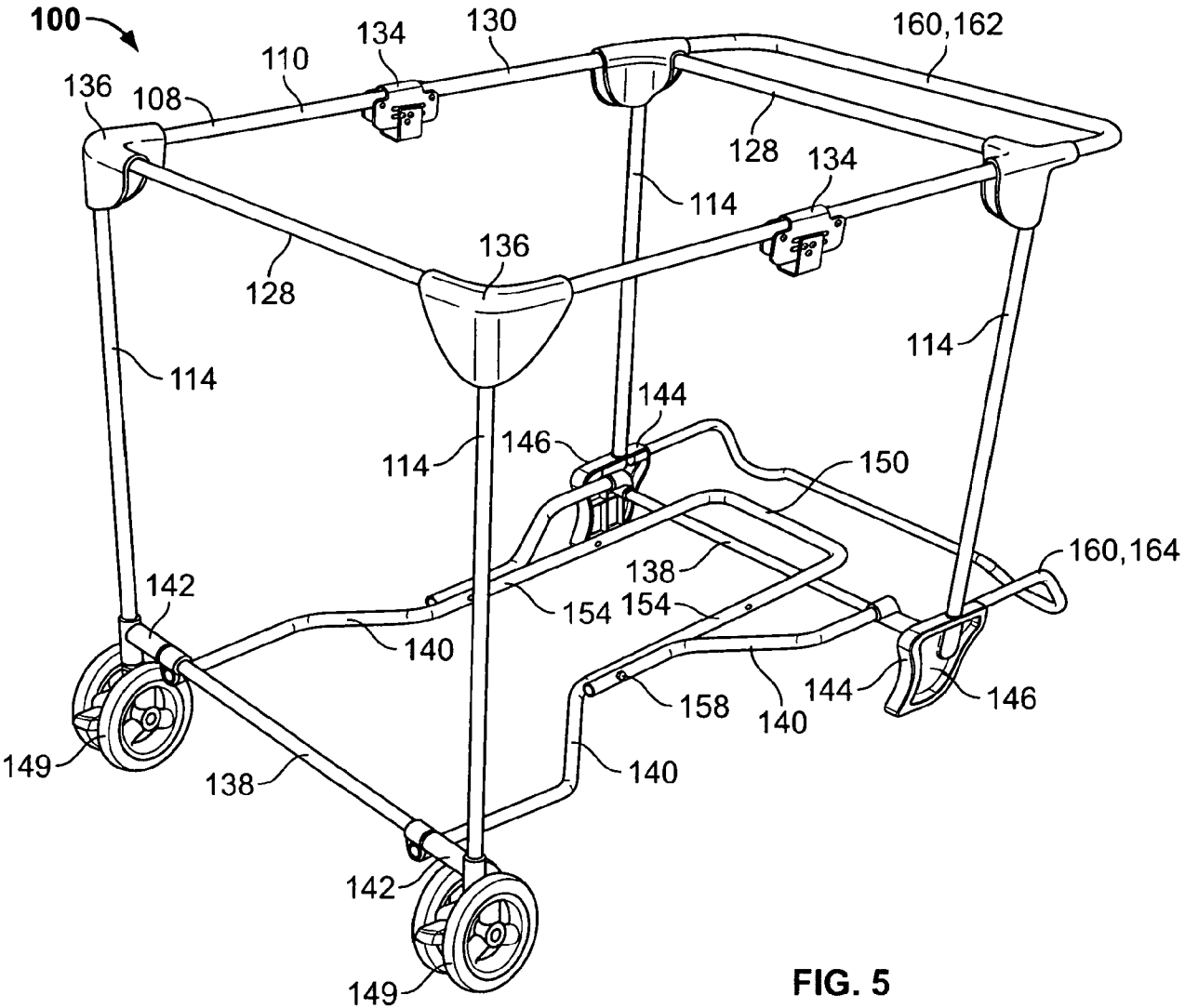
FIG. 5 is a rear perspective view of another example frame for a playard assembly constructed in accordance with the teachings of the invention, with each wheel assembly having a pair of wheels.

A method of collapsing the example playard assembly 100 is shown in FIGS. 4 and 6-10. The principles of operation of the example shown in FIG. 5 are substantially the same as shown in FIGS. 4 and 6-10. In FIGS. 4-10, the fabric panels are removed for convenient viewing of the movements of the frame 108 assembly. In other examples, the sides 154 of the handle 150 may have straight profiles and may be pivotally coupled to lower end member 138 separately from the lower corner housings 142.

Figure 6:
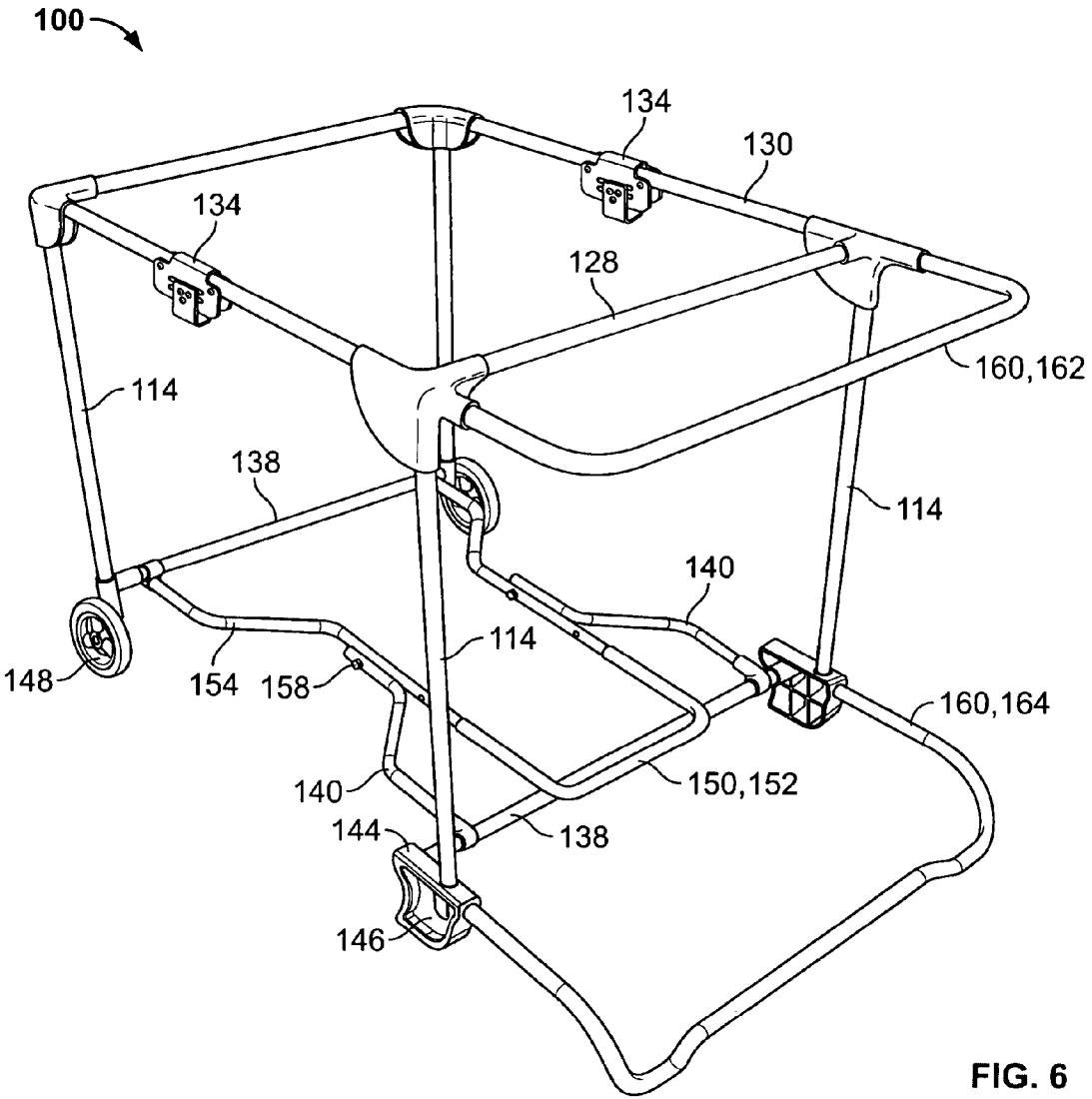
FIG. 6 is a front perspective view of the example frame of FIG. 1.
Figure 7:
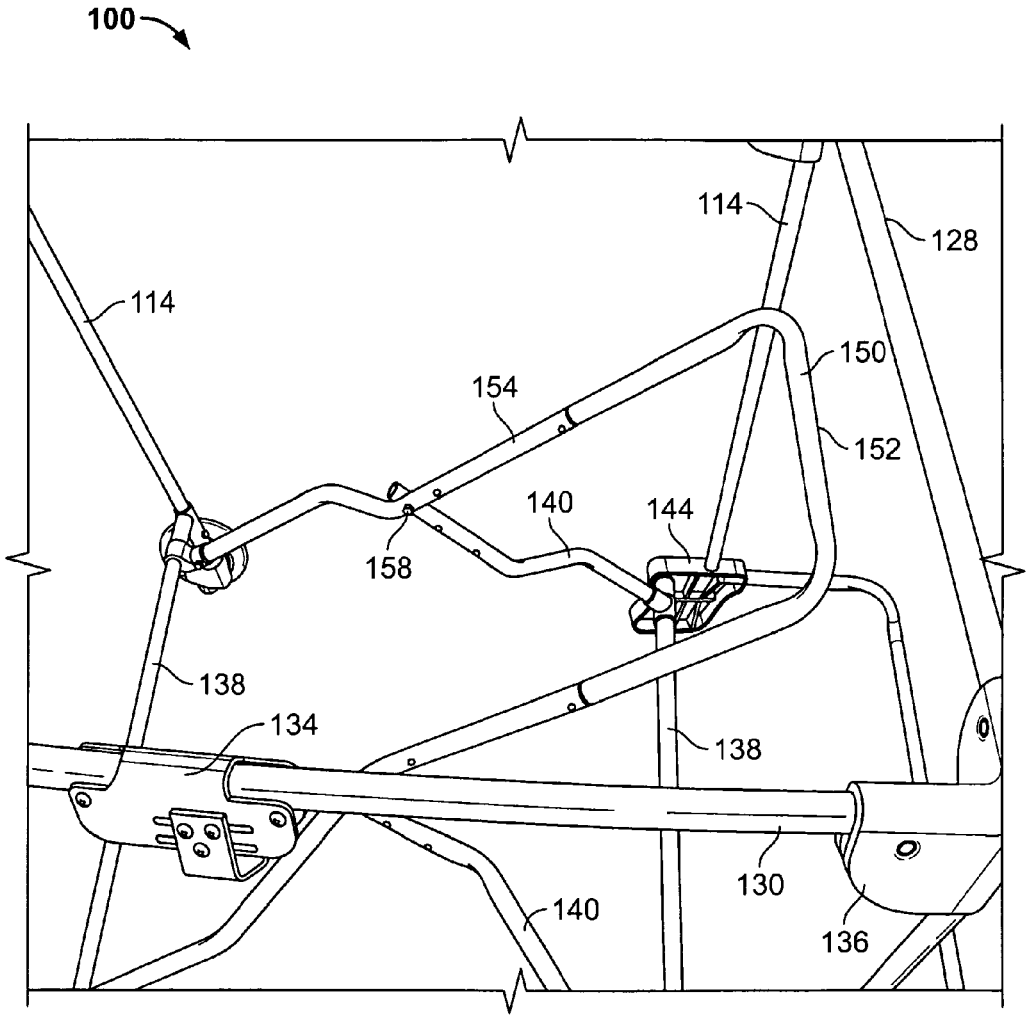
FIGS. 7-9 are perspective views of the example frame of FIG. 1, showing the frame as it is being folded toward a collapsed position.
Figure 8:
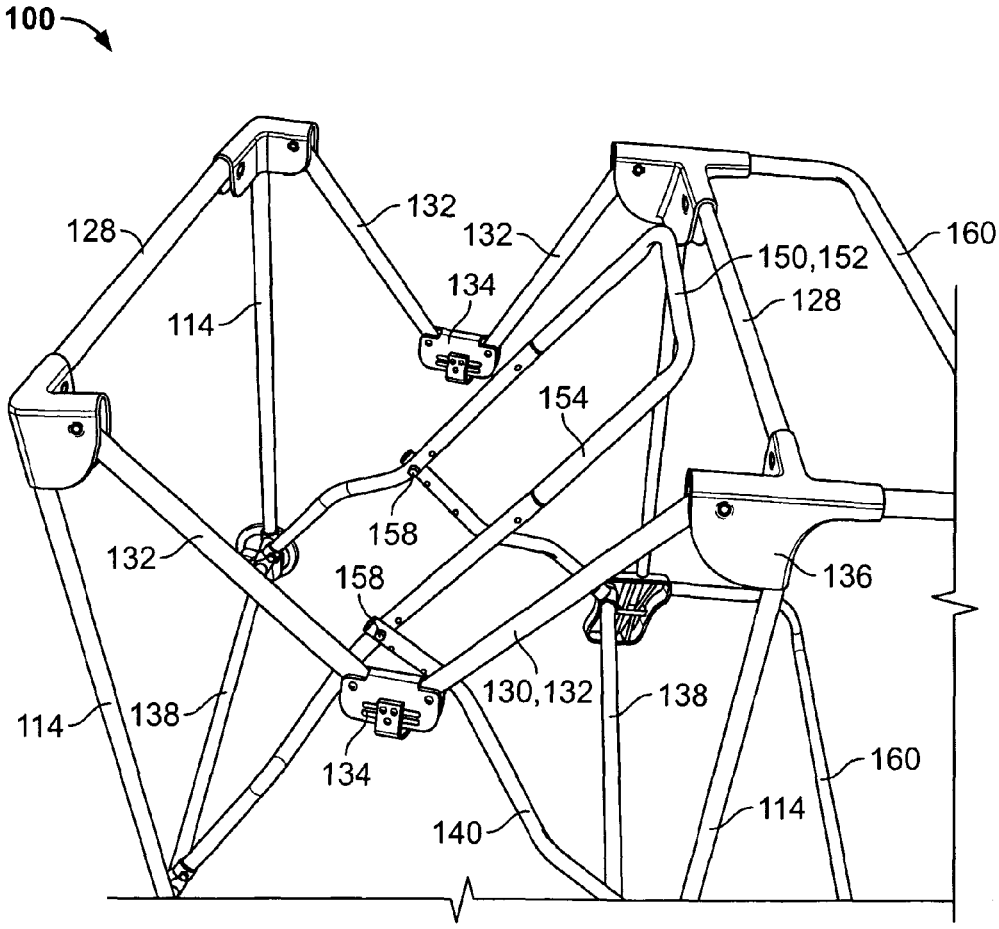

FIGS. 4 and 6-10 demonstrate the movement of the frame 108 from the erected position to the collapsed position (and the handle 150 from the floor support position to the handle position). To move from the collapsed position to the erected position, the movements shown in FIGS. 4 and 5-10 would be reversed. In FIGS. 4 and 6, the frame 108 is in a fully erected position for use of the playard portion 102 as an enclosure for a child. In FIG. 7, the handle member 150 is being lifted, thereby initiating movement of the lower frame 112 from its erected position toward a collapsed position. Subsequently, the lock mechanism of the upper rails 130 are released (e.g., via manual manipulation of actuation of the joints 134) to permit further folding. The lock joints can take any desired form and likewise can be released using any desired manual or automatic technique. In FIG. 8, the locking mechanisms of the rail joints 134 on the pair of upper collapsible side members 130 have been released, allowing the upper side members 130 to be folded toward a collapsed position as the handle member 150 is further lifted and the front and rear ends 128, 138 of the playard portion 102 continue to be moved toward each other by the lifting of the lower frame member 140.

Figure 9:
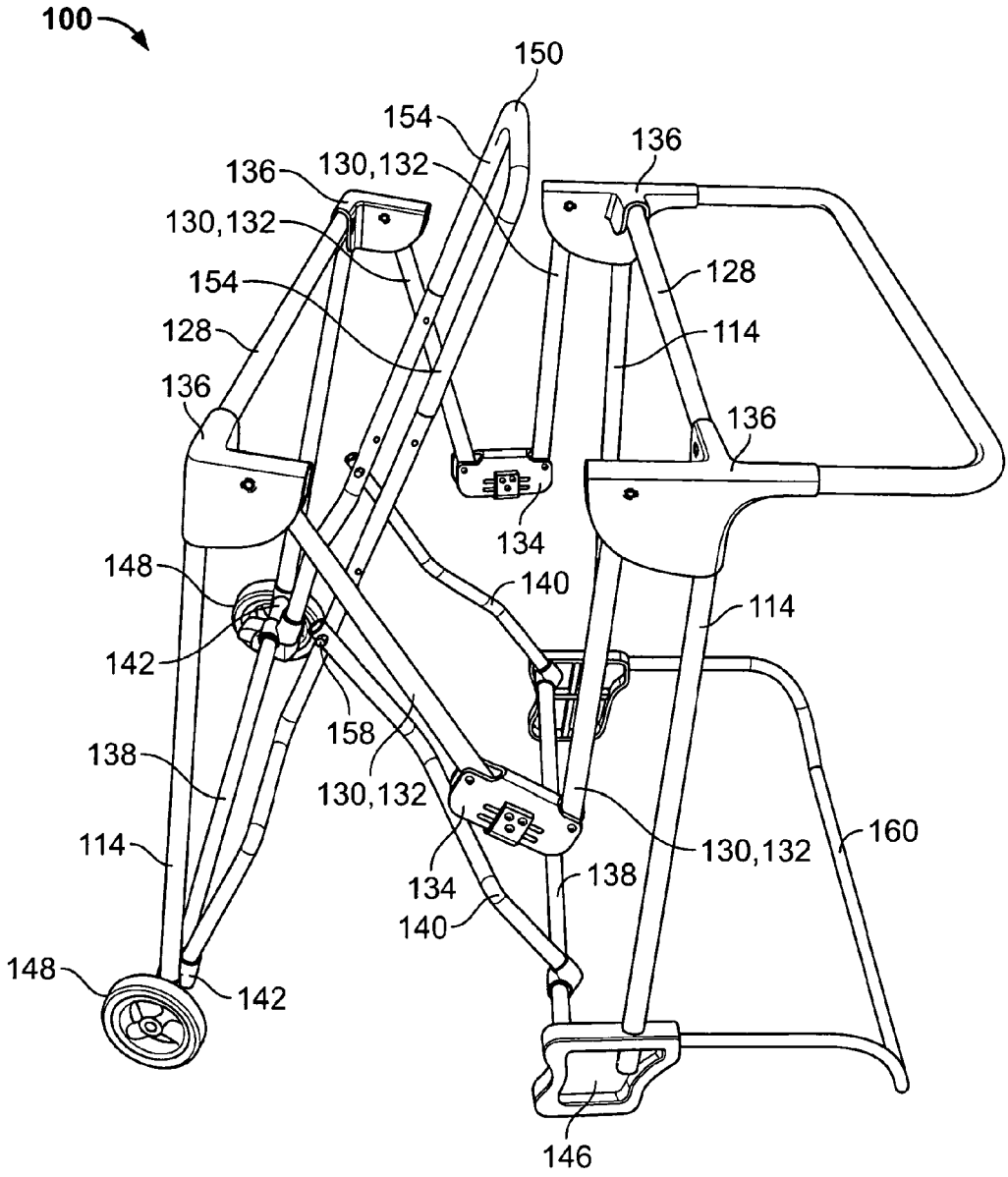
Figure 10:
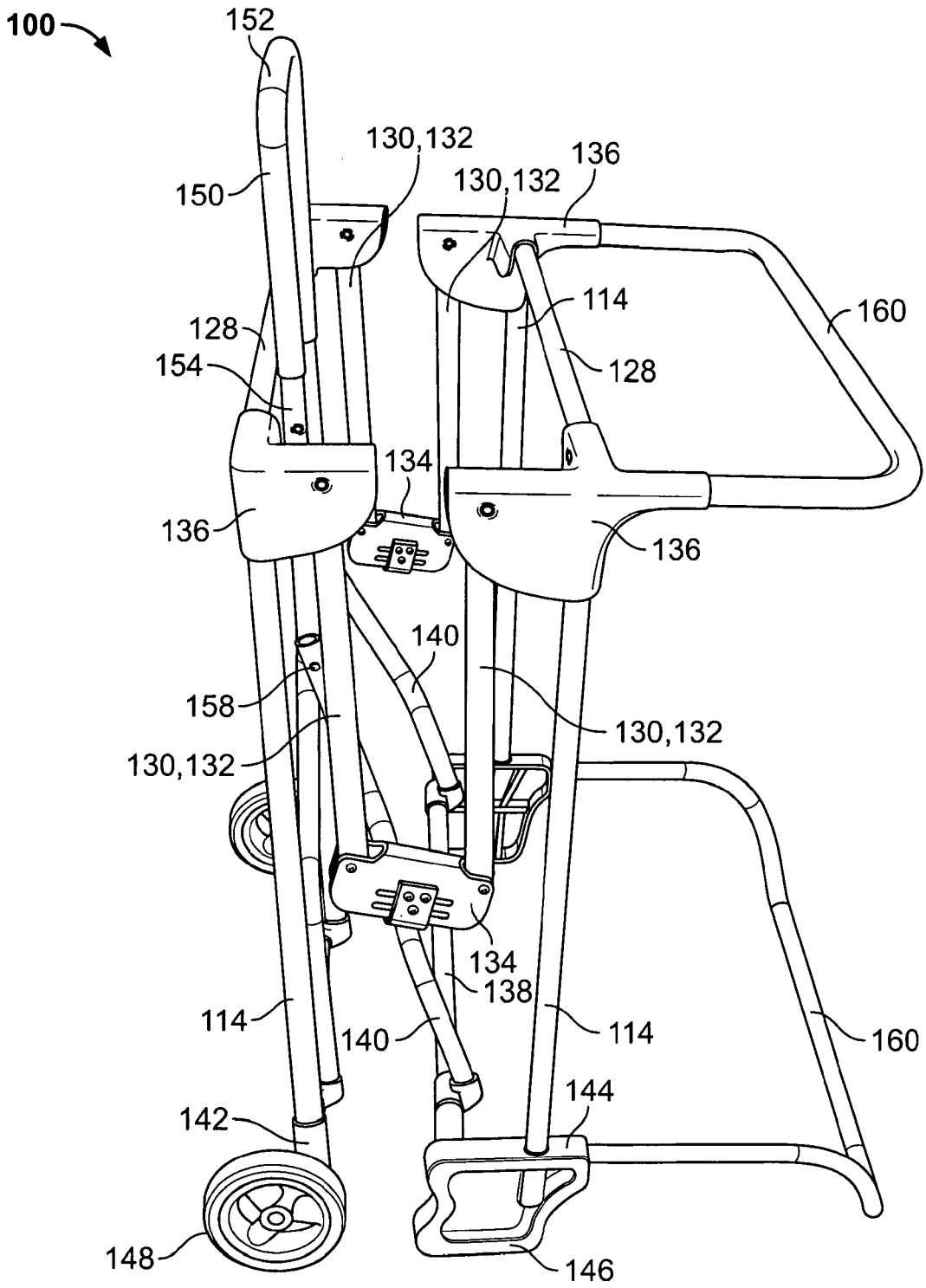
FIG. 10 is a view similar to FIGS. 7-9, but showing the frame in the collapsed position.
Figure 11:
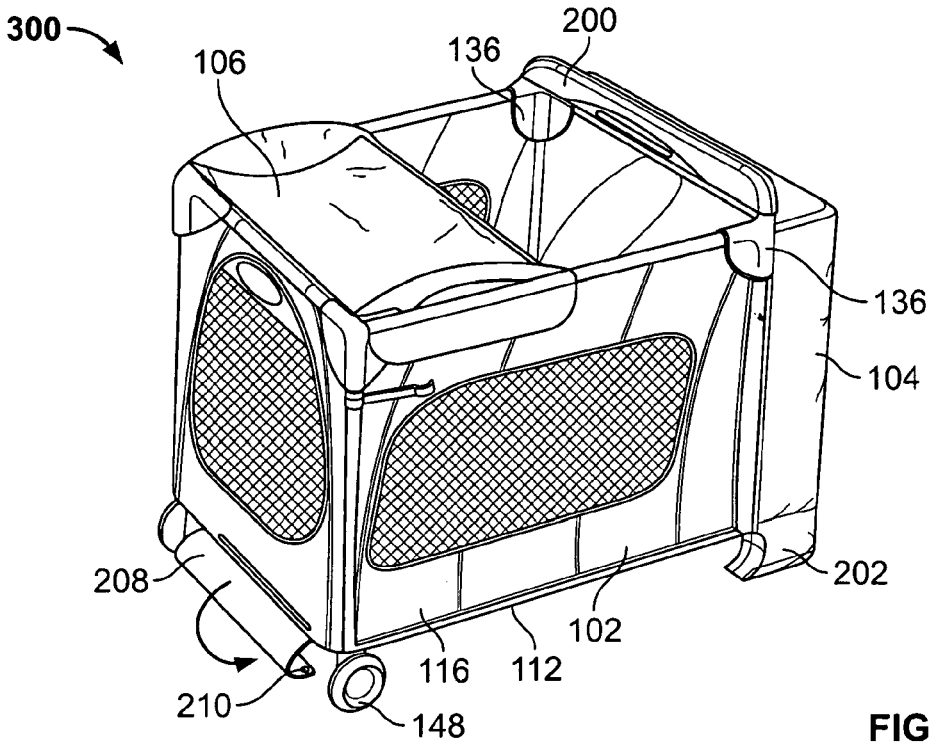
FIG. 11 is a rear perspective view of another example playard assembly constructed in accordance with the teachings of the invention and including an upper changing table mounted on the playard.

The collapsing process is continued, FIG. 9, with the handle member 150 moving upward beyond the upper frame 110. In FIG. 10, the handle member 150 has been moved to the substantially upright position wherein the handle member 150 is adjacent to and/or engages the upper rear end member 128. The upward movement of the pivotal connection 158 of the handle member 150 and the rails 140 of the lower frame 112 cause the playard portion ends 128, 138 to move toward each other in substantially parallel planes until, in the illustrated example, the pairs of rails of the upper side members 130 are substantially parallel to the upright corner posts 114. Once the fully collapsed position is achieved, a pair of latches 182 (see FIG. 2) is engaged to secure the front and rear upright corner posts 114 to each other at a fixed distance apart. An example latch 114, implemented as a strap, is shown in a secured position in FIG. 2, and in a released position in FIG. 1. Of course, other latching mechanisms could be utilized to lock the playard portion 102 in the collapsed position.

With the example playard assembly 100 latched in the collapsed position, the playard assembly 100 may be conveniently moved by holding the grasping portion 152 of the handle member 150, tilting the playard assembly 100 so as to rest on the wheels 148, and then pushing or pulling the handle member 150 to roll the playard assembly 100 over a ground surface. The playard assembly 100 also may be parked in a collapsed and upright position by resting the assembly 100 on the ground engaging wheels 148 and the legs 146, 166 that extend downward from the front lower corner housings 144 and from the lower extension member 164.

A further illustrated example of a foldable and portable playard assembly 300 with a storage compartment 104 is shown in FIGS. 11-14. The structures of the frame 108, 160 and storage compartment 104 for the example shown in FIGS. 11-14 may be constructed of similarly suitable materials to the examples shown in FIGS. 1-10. The example of FIGS. 11-14 differs from the examples of FIGS. 1-10 in that the extendable handle member 200 is provided as a telescopically extending handle member 200. Further, the downward extending legs 146 at the front end of the playard assembly shown in various ways in FIGS. 1-10 are replaced with one pair of legs 202 beneath the storage compartment.

In the example of FIGS. 11-14, the handle 200 is adjacent the front end of the playard portion 102, whether the playard assembly 300 is extended for use or is collapsed for transportation or storage. This is achieved by having the sides of the handle member 204 slidably received in the front upright corner posts 144. Locking mechanisms (not shown) are employed in the front upright corner posts 144 and/or the front upper corner housings 136 of the playard 102 to releasably lock the handle member 200 in a retracted position and/or in one or more extended positions. The locks of this example are implemented by spring buttons and mating holes (e.g., Valco pins). This example handle configuration allows alternative folding structures to be utilized for the frame of the playard portion 102 from those described above. Further, the handle 200 of FIGS. 11-14 is not used as a floor support and is not involved in the folding of the playard frame 108. For example, the upper side rails and the lower side rails may telescope together to move the play yard 300 from the erected to the collapsed position. Alternatively, an approach such as that shown in FIGS. 1-10 may be used, without the lower frame forming the handle.

Figure 12:
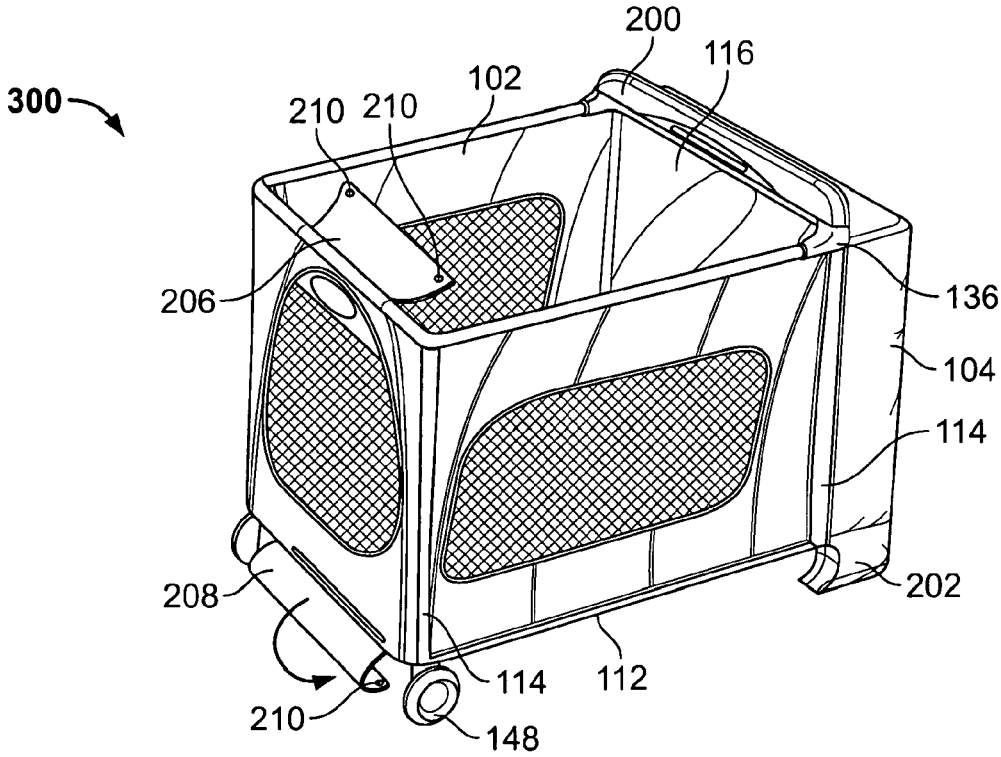
FIG. 12 is a rear perspective view of the example playard assembly of FIG. 11, shown with the changing table removed.
Figure 13:
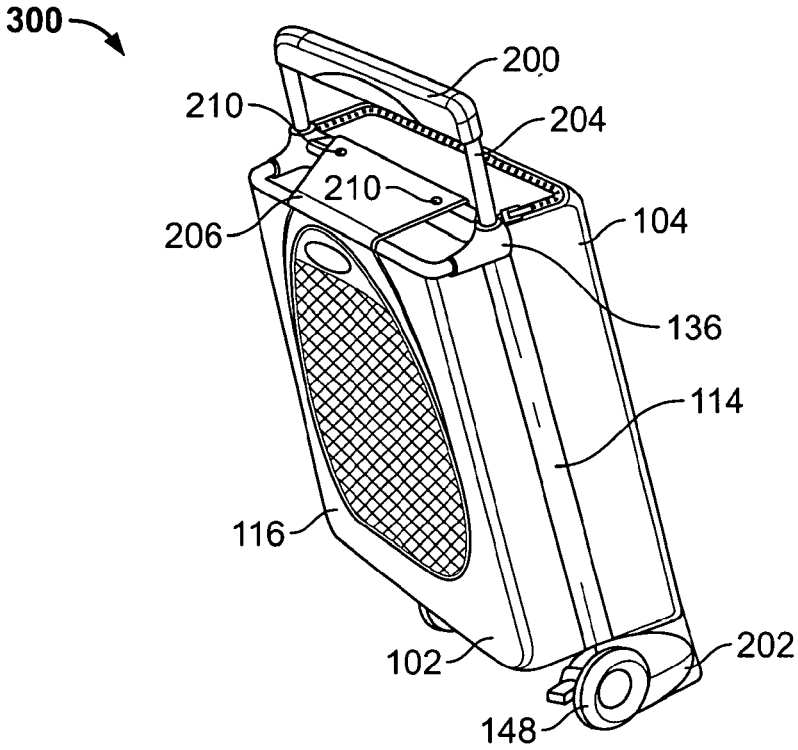
FIG. 13 is a rear perspective view of the example playard assembly of FIG. 11 in a collapsed position.
Figure 14:
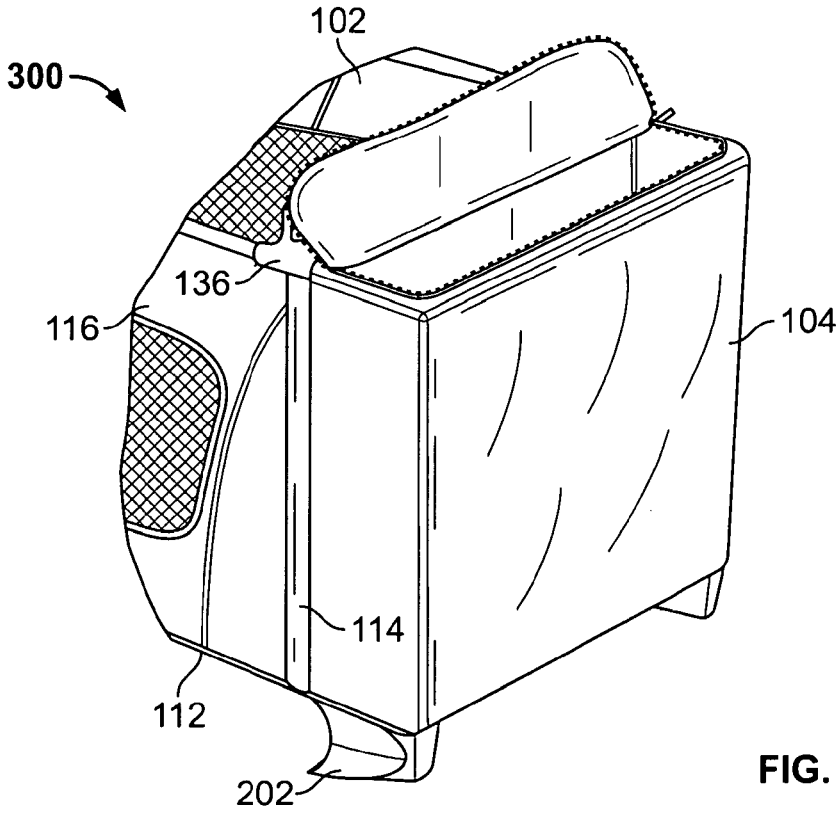
FIG. 14 is a partial front perspective view of the example playard assembly of FIG. 11 with the top of the storage compartment in an opened position.

The illustrated example shown in FIGS. 11-14 also provides alternative latching mechanisms to secure the front and rear ends 128, 138 of the playard assembly 300 when in a collapsed position for transportation or storage. In this regard, an upper flap 206 and a lower flap 208 with snap fasteners are provided, as shown in FIGS. 12 and 13. The flaps 206, 208 are joined to the top and bottom edge of the rear end fabric panel 116, respectively. The flaps 206, 208 have snap fastener receptacles 210 along their distal edge. The fastener receptacles 210 may be removably fastened to complementary snap fastener posts located on corresponding top and bottom edges of the front end fabric panel 116, respectively. The alternative illustrated example shown in FIGS. 11-14 also demonstrates that the front leg portions 202 that extend downward from the lower frame 112 may be located beneath the storage compartment 104, as opposed to the playard portion 102. Also, alternative accessories, such as the overlying changing table 106 shown in FIG. 11, or other accessories may be provided.

In the example of FIGS. 11-14, the lower legs 202 include curved profiles to receive the wheels 148 when the playard 300 is in the collapsed position. Also, as shown in FIG. 13, the handle 200 is raise and the upper flap 206 passed beneath the handle 200 to connect the snap fasteners 210.

As with the first illustrated example, the playard assembly 300 shown in FIGS. 11-14 may be conveniently rolled over a ground surface or parked in an upright position on the ground engaging wheels 148 and the legs located 202 beneath the storage compartment 104.

Figure 15:
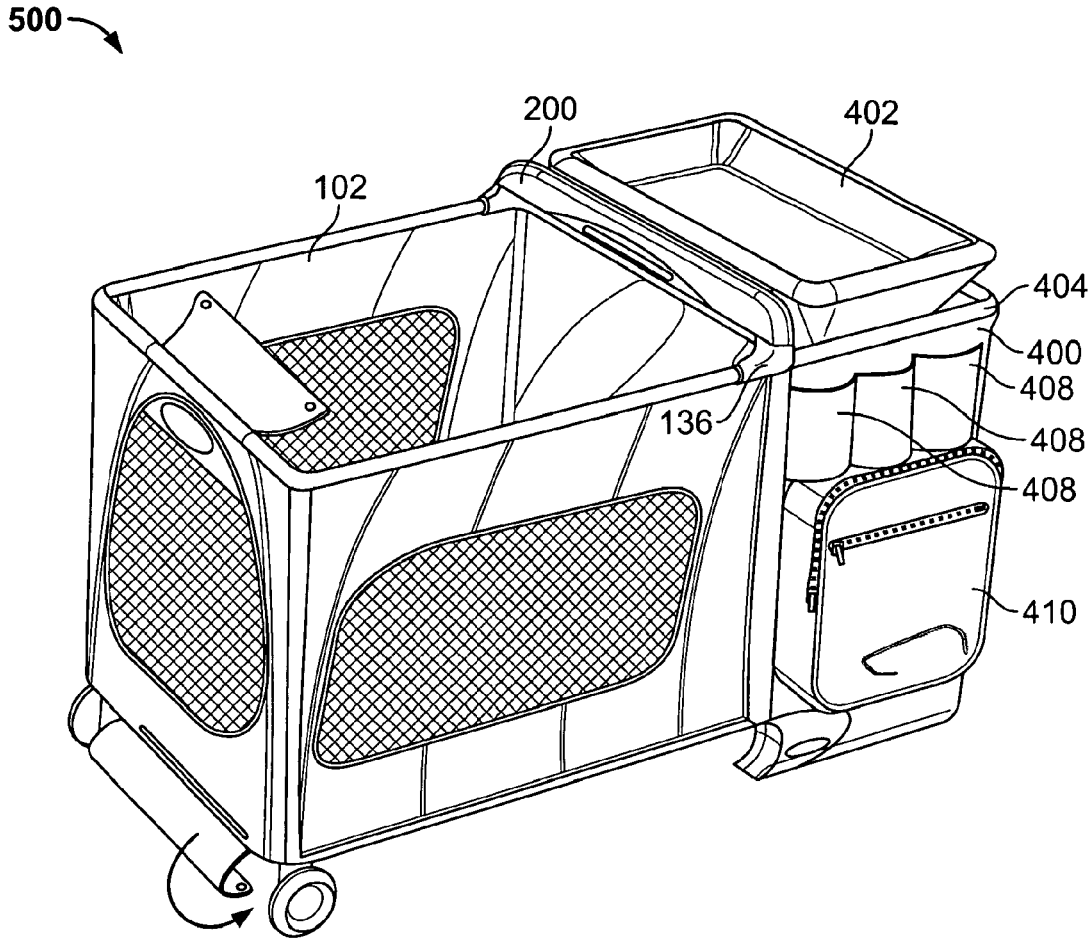
FIG. 15 is a rear perspective view of another example playard assembly constructed in accordance with the teachings of the invention and including an upper changing table positioned over a storage compartment.
Figure 16:
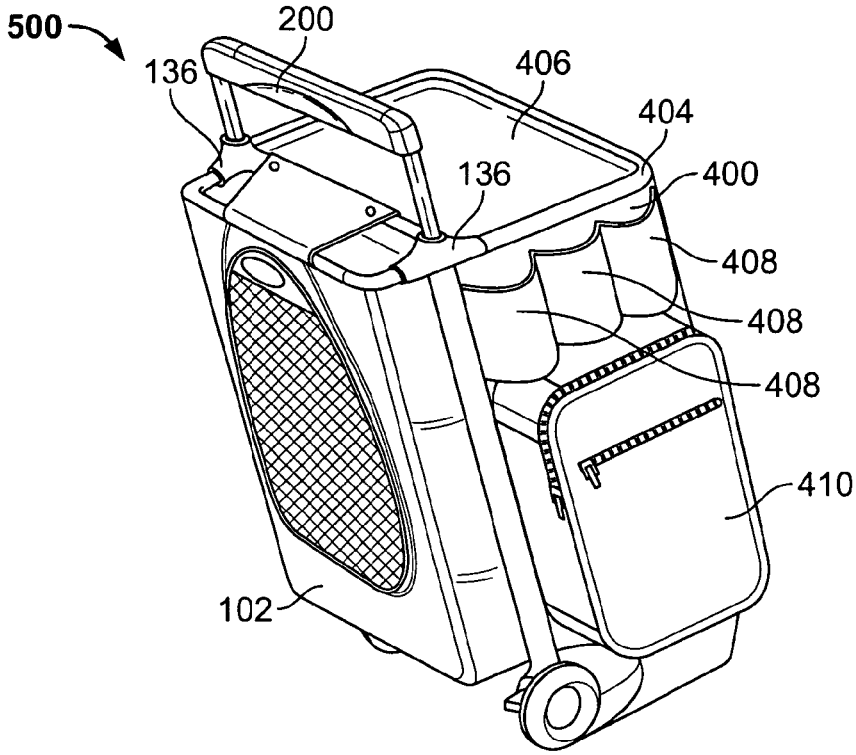
FIG. 16 is a rear perspective view of the example playard assembly of FIG. 15 in a collapsed position.
Figure 17:
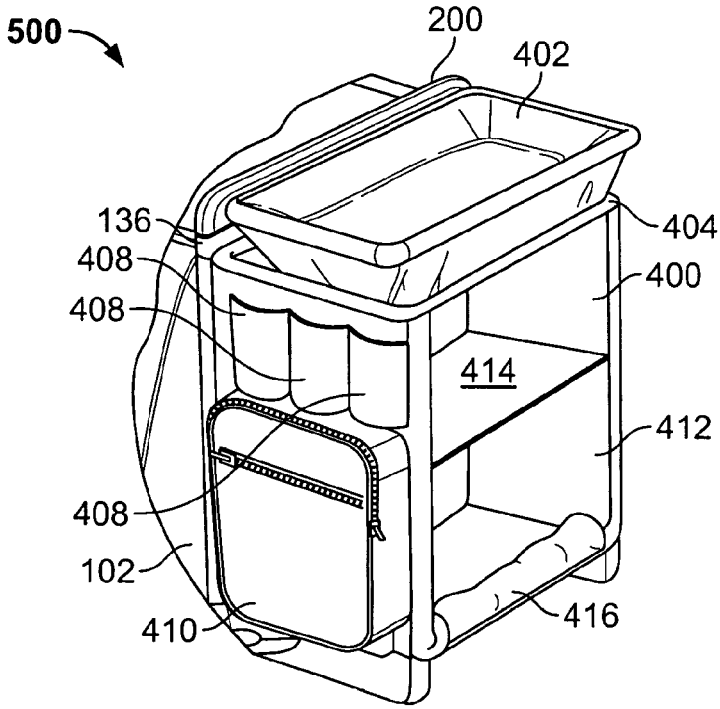
FIG. 17 is a partial front perspective view of the example playard assembly of FIG. 15.

Another example playard assembly 500 constructed in accordance with the teachings of the invention is shown in FIGS. 15-17. This example playard assembly 500 differs from the example shown in FIGS. 11-14 in that the storage compartment 400 is larger and includes a changing table 402. To this end, a storage compartment frame 404 is coupled to the front corner housings 136 and extends forward from the front end of the playard portion 102. In this example, the storage compartment 400 has a top panel 406 (see FIG. 16) that defines a tray surface that is dimensioned to receive a removable changing enclosure 402.

The storage compartment 400 shown in FIGS. 15-17 also includes multiple exterior pockets 408, such as for holding bottles, wipes, lotions, powder, or other accessories. It also includes an exterior zippered case 410 for enclosed storage that is separate from but adjacent to a main storage compartment 412. The main storage compartment 412 is shown as having shelves 414, but the main storage compartment 412 could be provided with no or different partitions or enclosures to assist in organizing items and/or to provide safe and secure stowage of goods. The main compartment 412 is shown in FIG. 17 as having a front panel 416 that may be rolled downward upon itself to provide unobstructed access to the interior of the compartment 412 when opened. The extendable handle 200 and load carrying capacity of the rotatable wheels 148 provide the ability to conveniently store and transport the playard assembly 500 even with a relatively larger storage compartment 400, such as that shown in FIGS. 15-17.

Foldable and portable playard assemblies with a storage compartment and methods of using the same have been disclosed. The example playards may be folded lengthwise into a suitcase like configuration for transport and/or storage. Although the described examples fold only in a lengthwise direction, playards that adopt the teachings of this disclosure to include sideways folding, either in addition to or in place of the lengthwise folding, are also contemplated and disclosed.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed:

1. A playard comprising:

a lower frame having a collapsed position and an erected position;

an upper frame having a collapsed position and an erected position;

a plurality of corner posts coupling the lower frame and the upper frame;

an upper extension member coupled to and extending from the upper frame; and a lower extension member coupled to extending from the lower frame, the upper extension member, the lower extension and two of the plurality of corner posts form a storage compartment frame, the storage compartment frame remains in an extended position when the lower frame is in the collapsed position and the upper frame is in the collapsed position.

2. A playard as defined in claim 1, wherein the storage compartment is accessible when the upper frame is in the collapsed position and the lower frame is in the collapsed position.

3. A playard as defined in claim 1, wherein the storage compartment includes an upper surface for supporting a changing table.

4. A playard as defined in claim 1, wherein a telescoping handle is coupled to two of the upper corner posts.

5. A playard as defined in claim 4, wherein the handle is to move between a lowered position and a raised position, and wherein the upper frame comprises side rails and opposed end rails, the end rails are to move toward each other and the side rails are to collapse as the upper frame moves from the erected position to the collapsed position, and the side rails are to collapse by folding.

6. A playard as defined in claim 5, wherein the side rails fold downward.

7. A playard as defined in claim 1, wherein the lower frame is coupled to two wheels opposite the lower extension and the lower extension includes two legs that have curved profiles to receive the two wheels.

8. A playard having a collapsed position and an erected position, the playard comprising:

an upper frame;

a lower frame including a cross rail, a first end rail pivotably coupled to the cross rail, a second end rail pivotably coupled to the cross rail, and a u-shaped rail coupling the first end rail and the second end rail, the u-shaped rail to move toward the upper frame as the first end rail and the second end rail pivot about the cross rail when the playard moves from the erected to the collapsed position; and a handle formed by the u-shaped rail when the playard is in the collapsed position.

9. A playard as defined in claim 8, wherein the u-shaped rail, the first end rail and the second send rail are integral.

10. A playard as defined in claim 8, wherein the lower frame further includes a third end rail, a fourth end rail and a second cross rail, the third end rail is pivotably coupled to the first end rail and the second cross rail, the fourth end rail is pivotably coupled to the second end rail and the second cross rail, wherein movement of the u-shaped rail toward the upper frame causes the third end rail to pivot about the second cross rail and to pivot relative to the first end rail and causes the fourth end rail to pivot about the second cross rail and to pivot relative to the second end rail.

11. A play yard as defined in claim 10, wherein movement of the u-shaped rail toward the upper frame cases the second cross rail to move toward the first cross rail.

12. A playard as defined in claim 10, wherein a portion of the u-shaped rail rests on the second cross rail when the playard is in the erected position.

13. A playard as defined in claim 8, wherein the u-shaped rail extends above the upper rail when the playard is in the collapsed position.

14. A playard as defined in claim 8, wherein the u-shaped rail is vertically aligned with the first cross rail when the playard is in the collapsed position.

15. A method of operating a portable playard comprising:

moving a handle from a generally horizontal position to an upright position to move an upper frame and a lower frame from an erected position to a collapsed position, wherein the handle is a u-shape rail that is coupled to a first end rail of the lower frame and a second end rail of the lower frame, and moving the handle comprises:

rotating the first end rail relative to a first cross rail of the lower frame, rotating the second end rail relative to the first cross rail, rotating a third end rail coupled to the first end rail relative to the first end rail and a second cross rail, and rotating a fourth end rail coupled to the second end rail relative to the second end rail and the second cross rail; and latching a fastener to secure the playard in the collapsed position.

16. A method of operating a portable playard as defined in claim 15 further comprising moving an upper frame joint between a locked state and an unlocked state.

17. A method of operating a portable playard as defined in claim 15, wherein movement of the handle causes one of the first cross rail or the second cross rail to move toward the other of the first cross rail or the second cross rail without either of the first cross rail or the second cross rail folding.

18. A method of operating a portable playard comprising:

unlatching a fastener that secures a playard in a collapsed position; and moving a handle from an upright position to a generally horizontal position to move an upper frame and a lower frame from the collapsed position to an erected position wherein the handle is a u-shaped rail that is coupled to a first end rail of the lower frame and a second end rail of the lower frame, and moving the handle comprises:

rotating the first end rail relative to a first cross rail of the lower frame, rotating the second end rail relative to the first cross rail, rotating a third end rail coupled to the first end rail relative to the first end rail and a second cross rail, and rotating a fourth end rail coupled to the second end rail relative to the second end rail and the second cross rail.

19. A method of operating a portable playard as defined in claim 18 further comprising moving an upper frame joint between an unlocked state and a locked state.

20. A method of operating a portable playard as defined in claim 18, wherein movement of the handle causes one of the first cross rail or the second cross rail to move away from the other of the first cross rail or the second cross rail without either of the first cross rail or the second cross rail folding or unfolding.

* * * * *